US010759626B2

(12) United States Patent
Naitou

(10) Patent No.: US 10,759,626 B2
(45) Date of Patent: Sep. 1, 2020

(54) SHEET SAFEKEEPING APPARATUS AND IMAGE PROCESSING APPARATUS

(71) Applicant: TOSHIBA TEC KABUSHIKI KAISHA, Shinagawa-ku, Tokyo (JP)

(72) Inventor: Tomoki Naitou, Nagaizumi Sunto Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/229,002

(22) Filed: Dec. 21, 2018

(65) Prior Publication Data

US 2020/0198917 A1 Jun. 25, 2020

(51) Int. Cl.

| | |
|---|---|
| ***B65H 31/24*** | (2006.01) |
| ***B65H 39/11*** | (2006.01) |
| ***B65H 31/30*** | (2006.01) |

(52) U.S. Cl.

CPC ..... *B65H 31/24* (2013.01); *B65H 31/3081* (2013.01); *B65H 39/11* (2013.01); *B65H 2402/441* (2013.01); *B65H 2405/115* (2013.01); *B65H 2405/332* (2013.01); *B65H 2511/412* (2013.01); *B65H 2601/321* (2013.01)

(58) Field of Classification Search

CPC .... B65H 31/24; B65H 31/3081; B65H 39/11; B65H 2405/332; G03G 15/6538

See application file for complete search history.

(56) References Cited

U.S. PATENT DOCUMENTS 5,525,031 A * 6/1996 Fox ..... B65H 39/11 399/404
5,645,396 A * 7/1997 Romanowski ..... B65H 31/3063 414/789.9
6,421,582 B1 * 7/2002 Wada ..... G03G 15/6538 194/239
6,568,675 B1 * 5/2003 Boss ..... B65H 31/22 271/292
9,567,181 B2 2/2017 Tsuji et al.
2015/0069697 A1 * 3/2015 Suzuki ..... B65H 31/24 271/213

FOREIGN PATENT DOCUMENTS

JP 01127565 A * 5/1989
JP 09216759 A * 8/1997
JP 2000053314 A * 2/2000
JP 2013107763 A * 6/2013

* cited by examiner

*Primary Examiner* — Luis A Gonzalez

(74) *Attorney, Agent, or Firm* — Amin, Turocy & Watson, LLP

(57) ABSTRACT

A sheet safekeeping apparatus comprises a multistage tray in which a plurality of housing sections for accommodating sheets is arranged in a first direction, a removal port through which the accommodated sheet is taken out being formed in each of the plurality of the housing sections, and a cover configured for to close the removal port in an openable manner being provided in each of the plurality of the housing sections; a support section configured to support the multistage tray; a tray displacement unit configured to displace the multistage tray in the first direction with the support section; a conveyance unit configured to convey a sheet to the plurality of the housing sections; and a cover displacement unit configured to displace the cover of one housing section determined by an operation of the tray displacement unit among the plurality of the housing sections to open the removal port.

20 Claims, 7 Drawing Sheets

SHEET SAFEKEEPING APPARATUS AND IMAGE PROCESSING APPARATUS

FIELD

Embodiments described herein relate generally to a sheet safekeeping apparatus, an image processing apparatus, and methods associated therewith.

BACKGROUND

In a conventional image processing apparatus such as a printer, a sheet discharge section includes a plurality of sheet discharge trays. If a plurality of users uses such an image processing apparatus, discharged sheets on which images are recorded are sorted and accommodated. For example, a plurality of the sheet discharge trays is used as job separators. The job separator sorts the sheets by job to discharge them. A sheet safekeeping apparatus such as a job separator enables a user who succeeds in authentication to take out the sheets which are accommodated on the sheet discharge trays and on which images are formed. As a result, the sheet safekeeping apparatus ensures the confidentiality of the accommodated sheets on which images are formed. However, in order to take out sheets from a plurality of the sheet discharge trays, it is necessary to provide a driving source for opening and closing a removal port in each of a plurality of the sheet discharge trays. Therefore, there is a problem that the configuration of the sheet safekeeping apparatus becomes complicated.

DETAILED DESCRIPTION

In accordance with an embodiment, a sheet safekeeping apparatus comprises a multistage tray in which a plurality of housing sections for accommodating sheets is arranged side by side in a first direction, a removal port through which the accommodated sheet is taken out being formed in each of the plurality of the housing sections, and a cover for closing the removal port in an openable manner being provided in each of the plurality of the housing sections; a support section configured to support the multistage tray; a tray displacement unit configured to displace the multistage tray in the first direction with respect to the support section; a conveyance unit, arranged in the support section, configured to convey the sheet to a plurality of the housing sections; and a cover displacement unit, arranged in the support section, configured to displace the cover of one housing section determined by an operation of the tray displacement unit among the plurality of the housing sections to open the removal port.

Hereinafter, a sheet safekeeping apparatus and an image processing apparatus according to an embodiment are described with reference to the accompanying drawings.

Figure 1:
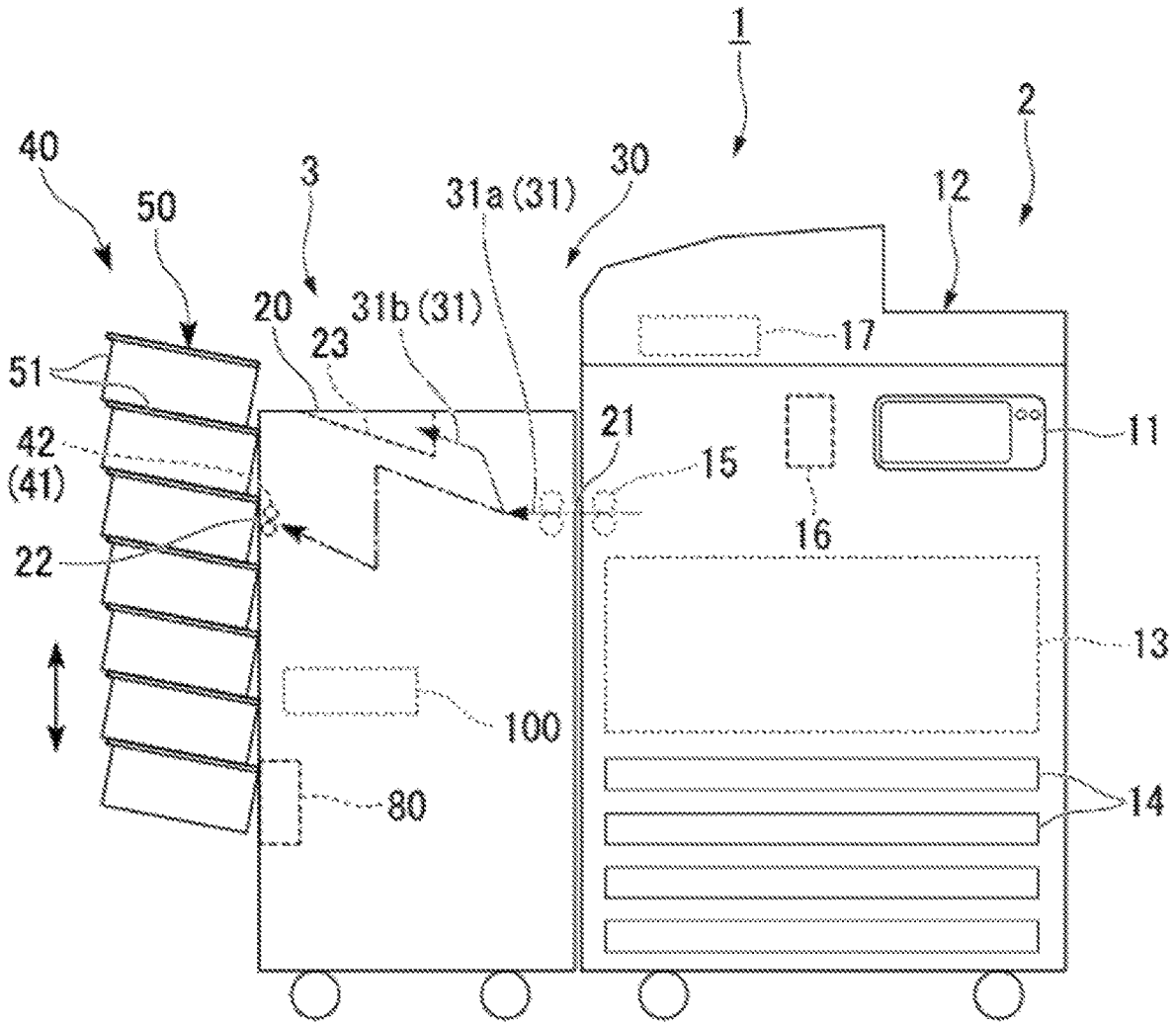
FIG. 1 is a front view illustrating an image forming apparatus according to an embodiment.
Figure 2:
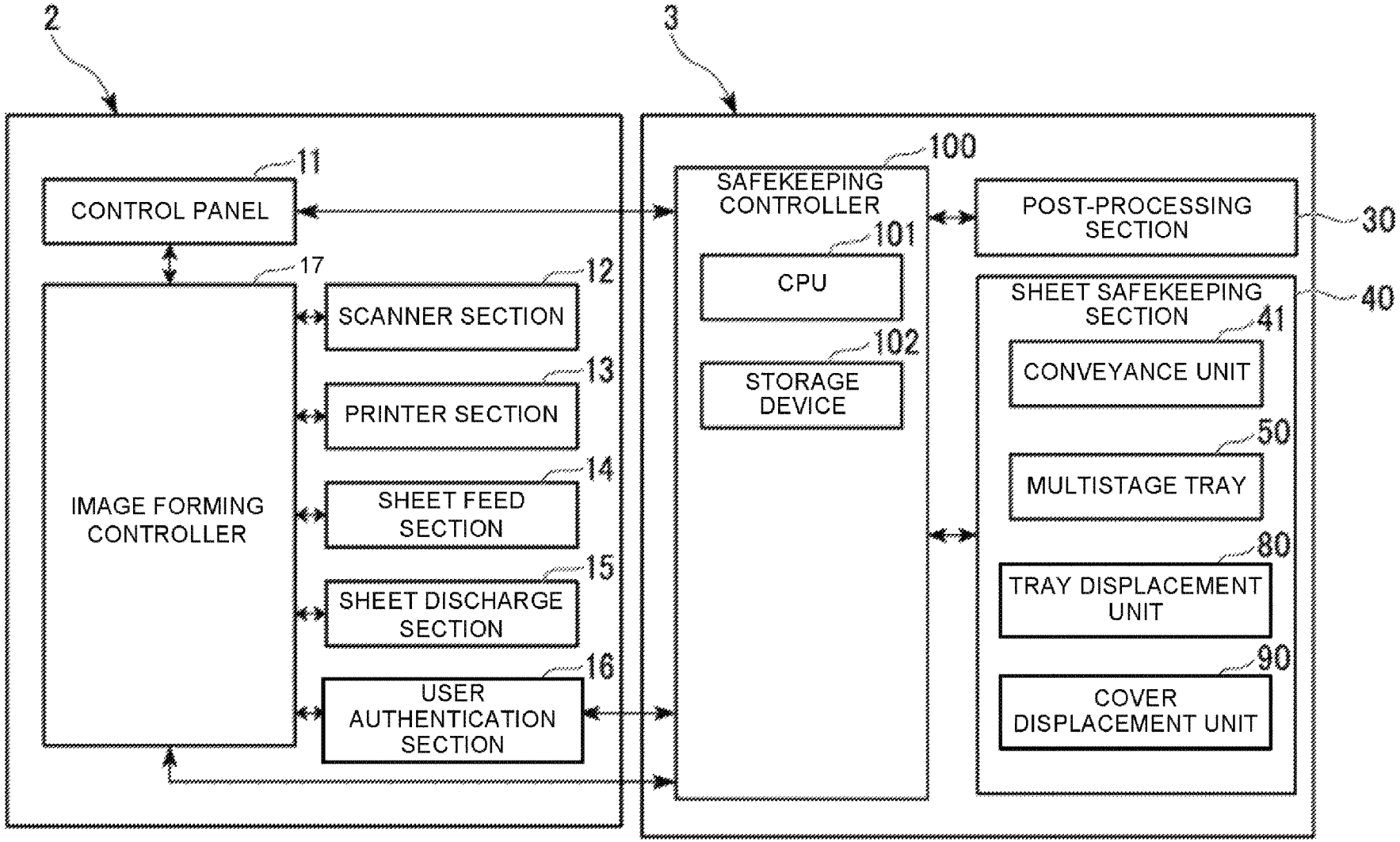
FIG. 2 is a block diagram illustrating an example of functional components of the image forming apparatus according to the embodiment.

FIG. 1 is a front view illustrating an image forming apparatus according to an embodiment. FIG. 2 is a block diagram illustrating an example of functional components of the image forming apparatus according to the embodiment.

An image forming apparatus 1 comprises an image forming apparatus main body 2 and a sheet safekeeping apparatus 3. The image forming apparatus main body 2 forms an image on a sheet-like medium such as a paper (hereinafter, collectively referred to as a "sheet S"). The image forming apparatus main body 2 discharges the sheet S on which an image is formed and sends it to the sheet safekeeping apparatus 3. The sheet safekeeping apparatus 3 stores the sheet S discharged from the image forming apparatus main body 2.

The image forming apparatus main body 2 comprises a control panel 11, a scanner section 12, a printer section 13, a sheet feed section 14, a sheet discharge section 15, a user authentication section 16 and an image forming controller 17.

The control panel 11 includes an operation section, a display section, and a panel controller. The operation section receives an operation from a user. For example, the operation section includes various keys and a touch panel. The display section displays various kinds of information. The panel controller controls reception of an operation from a user by the operation section and display on the display section. The panel controller is a control circuit having a CPU (Central Processing Unit), a ROM (Read Only Memory), and a RAM (Random Access Memory). For example, the control panel 11 receives an input relating to removal of the sheet S accommodated in the sheet safekeeping apparatus 3. The image forming apparatus main body 2 sends information relating to the sheet S received by the control panel 11, information relating to a type of post-processing, and the like to the sheet safekeeping apparatus 3.

The scanner section 12 reads the image information of a copy object as intensity of light. The scanner section 12 sends the read image information to the printer section 13.

The printer section 13 forms an output image (hereinafter referred to as a "toner image") formed with a developer such as toner based on image information received from the scanner section 12 or an external device. The printer section 13 transfers the toner image onto a surface of the sheet S. The printer section 13 applies heat and pressure to the toner image on the surface of the sheet S to fix the toner image on the sheet S. The printer section 13 sends the sheet S on which the toner image is fixed to the sheet discharge section 15.

The sheet feed section 14 supplies the sheets S one by one to the printer section 13 in accordance with a timing at which the printer section 13 forms a toner image. For example, the sheet feed section 14 includes a plurality of sheet feed cassettes. Each sheet feed cassette accommodates a sheet S of a preset size and type in advance. Each sheet feed cassette has a pickup roller. Each pickup roller takes out the sheets S one by one from each sheet feed cassette. Each pickup roller sends the sheet S taken out from each sheet feed cassette to the printer section 13.

The sheet discharge section 15 sends the sheet S received from the printer section 13 to the sheet safekeeping apparatus 3.

The user authentication section 16 authenticates a user. The user authentication section 16 authenticates the user based on read personal authentication information of the user. For example, the user authentication section 16 authenticates the user by comparing the personal authentication information of the user with authentication information stored in a database (not shown). The user authentication section 16 determines that the authentication of the user succeeds when the read personal authentication information matches the authentication information stored in a storage section (not shown). For example, the user authentication section 16 is a card reader or the like. The card reader reads the personal authentication information stored in an ID (identity) card etc. possessed by the user.

The image forming controller 17 controls the overall operation of the image forming apparatus main body 2. The image forming controller 17 controls the control panel 11, the scanner section 12, the printer section 13, the sheet feed section 14, the sheet discharge section 15 and the user authentication section 16. The image forming controller 17 is a control circuit having a CPU, a ROM, and a RAM. The image forming controller 17 executes a job designated by the user when the personal authentication succeeds in the user authentication section 16. The image forming controller 17 sends the user information of a user who executes a job to a safekeeping controller 100 described later.

The sheet safekeeping apparatus 3 is adjacent to the image forming apparatus main body 2. The sheet safekeeping apparatus 3 comprises a housing 20 (support section), a post-processing section 30, a sheet safekeeping section 40 and the safekeeping controller 100.

The housing 20 mainly contains the components of the post-processing section 30 therein. In the housing 20, a sheet supply port 21 and a sheet discharge port 22 are formed. The sheet supply port 21 is formed to face the sheet discharge section 15 of the image forming apparatus main body 2. The sheet S discharged from the image forming apparatus main body 2 is sent to the inside of the housing 20 through the sheet supply port 21. The sheet discharge port 22 is formed at a position facing the opposite side of the sheet supply port 21 in the housing 20. The sheet S sent from the post-processing section 30 to the sheet safekeeping section 40 passes through the sheet discharge port 22. On the top of the housing 20, a fixed tray 23 is formed. The sheet S is discharged to the fixed tray 23. The fixed tray 23 supports the sheet S received from the post-processing section 30.

The post-processing section 30 executes a post-processing designated through the control panel 11 on the sheet S conveyed from the image forming apparatus main body 2. For example, the post-processing is a sorting processing, stapling processing, or the like. The post-processing section 30 includes a conveyance path 31. The conveyance path 31 is provided in the housing 20. The conveyance path guides the sheet S received from the image forming apparatus main body 2 to the sheet discharge port 22 or the fixed tray 23. The conveyance path 31 includes a first conveyance path 31*a* and a second conveyance path 31*b*. The first conveyance path 31*a* guides the sheet S from the sheet supply port 21 to the sheet discharge port 22. The second conveyance path 31*b* branches from the first conveyance path 31*a* and directs to the fixed tray 23.

The post-processing section 30 can perform the post-processing on the sheet S conveyed along the first conveyance path 31*a*. The post-processing section 30 may not perform the post-processing on the sheet S conveyed along the first conveyance path 31*a*. The post-processing section 30 does not perform the post-processing on the sheet S conveyed along the second conveyance path 31*b*.

Figure 3:
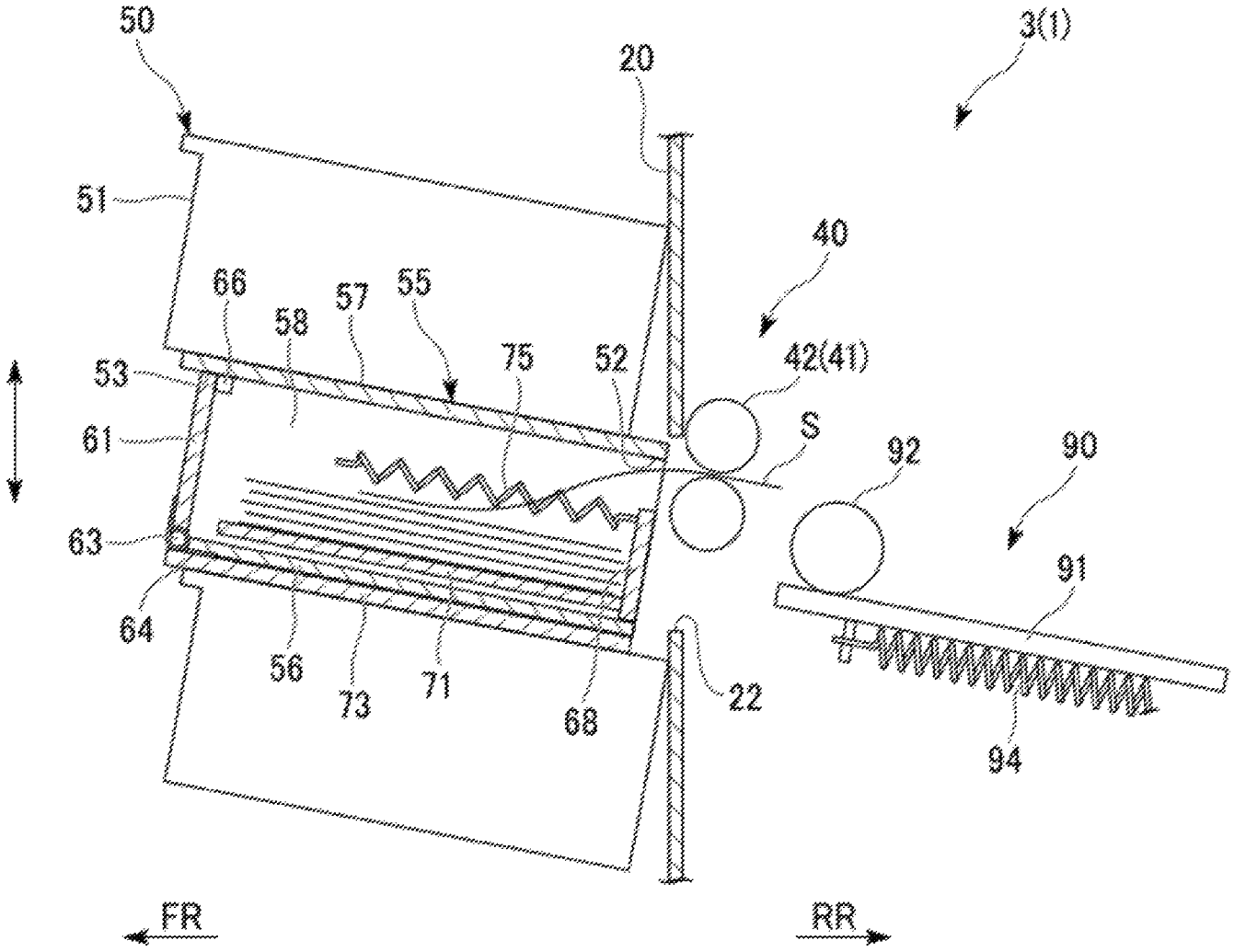
FIG. 3 is a front view illustrating a part of a sheet safekeeping apparatus according to the embodiment.

FIG. 3 is a front view illustrating a part of the sheet safekeeping apparatus according to the embodiment.

As shown in FIG. 1 and FIG. 3, the sheet safekeeping section 40 stores the sheet S conveyed from the post-processing section 30. The sheet safekeeping section 40 includes a conveyance unit 41, a multistage tray 50, a tray displacement unit 80 and a cover displacement unit 90.

Figure 4:
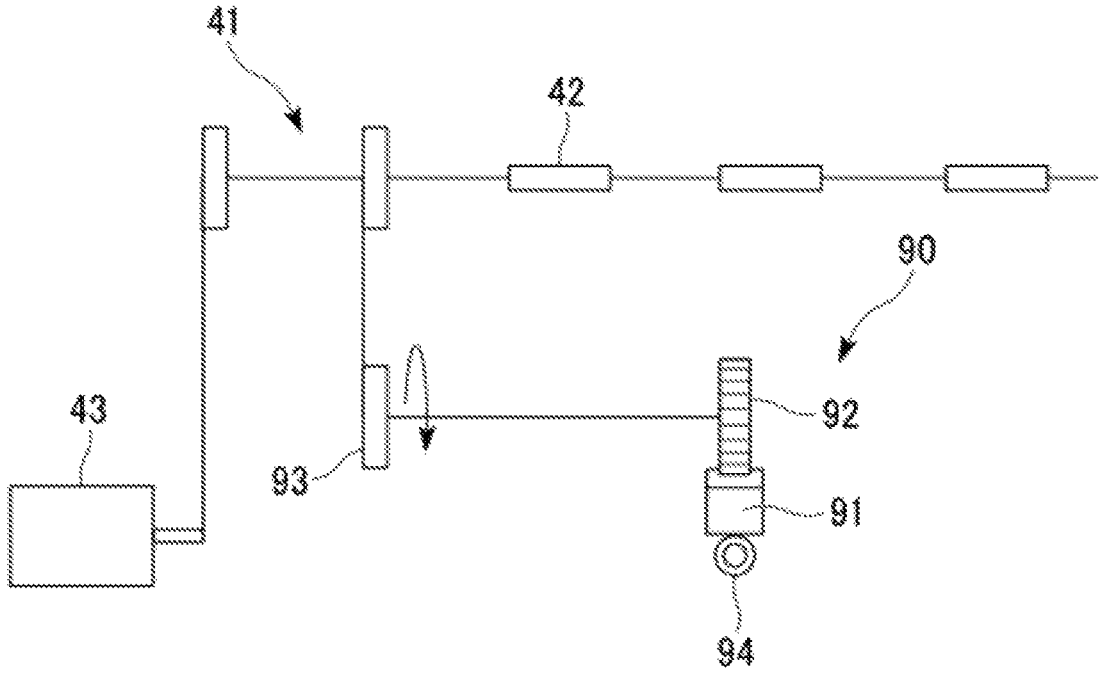
FIG. 4 is a schematic view of a conveyance unit and a cover displacement unit as viewed from an image forming apparatus main body side according to the embodiment.

FIG. 4 is a schematic diagram of the conveyance unit and the cover displacement unit as viewed from the image forming apparatus main body side according to the embodiment.

As shown in FIG. 3 and FIG. 4, the conveyance unit 41 conveys the sheet S to a later-described housing section 51 of the multistage tray 50. The conveyance unit 41 is arranged in the housing 20. The conveyance unit 41 includes a conveyance roller 42 and a conveyance motor 43.

The conveyance roller 42 is arranged at a downstream end of the first conveyance path 31*a* of the post-processing section 30 in a sheet conveyance direction (refer to FIG. 1). The conveyance roller 42 sends the sheet S received from the first conveyance path 31*a* to the housing section 51 when normally rotating. The conveyance roller 42 sends the sheet S to the housing section 51 via the sheet discharge port 22.

The conveyance motor 43 drives the conveyance roller 42. For example, the conveyance motor 43 is a DC (Direct Current) motor. The conveyance motor 43 can output rotational driving forces in two directions. The conveyance motor 43 enables the conveyance roller 42 to normally rotate by outputting a rotational driving force in a first direction. The conveyance motor 43 enables the conveyance roller 42 to reversely rotate by outputting a rotational driving force in a second direction. Here, in the horizontal direction, a direction in which the sheet S is discharged from the sheet discharge port 22 is defined as a forward direction, and an opposite side thereof is defined as a rearward direction. In the horizontal direction, a direction orthogonal to the front-rear direction is referred to as a left-right direction. In each figure, an arrow FR indicates the forward direction, and an arrow RR indicates the rearward direction.

As shown in FIG. 1, the multistage tray 50 is adjacent to the housing 20. The multistage tray 50 faces the image forming apparatus main body 2 across the housing 20. The multistage tray 50 is supported by the housing 20. The multistage tray 50 includes a plurality of the housing sections 51 arranged side by side in a vertical direction (first direction). The plurality of the housing sections 51 has the same configuration except for the position thereof in the vertical direction.

As shown in FIG. 3, the housing section 51 accommodates the sheet S conveyed by the conveyance unit 41. The housing section 51 can be switched between a storage state and a removal state. The storage state is a state in which the sheet S cannot be taken out from the housing section 51 as the cover 61 is closed. The removal state is a state in which the sheet S can be taken out from the housing section 51 as the cover 61 is open. In the following description of the configuration of the housing section 51, the housing section in the storage state is described if there is no particular description.

A plurality of the housing sections 51 is arranged in plural stages. The housing section 51 is formed into a box shape, in which an entry port 52 through which the sheet S is carried and a removal port 53 through which the sheet S is taken out are formed. The entry port 52 faces the sheet discharge port 22 of the housing 20.

Figure 5:
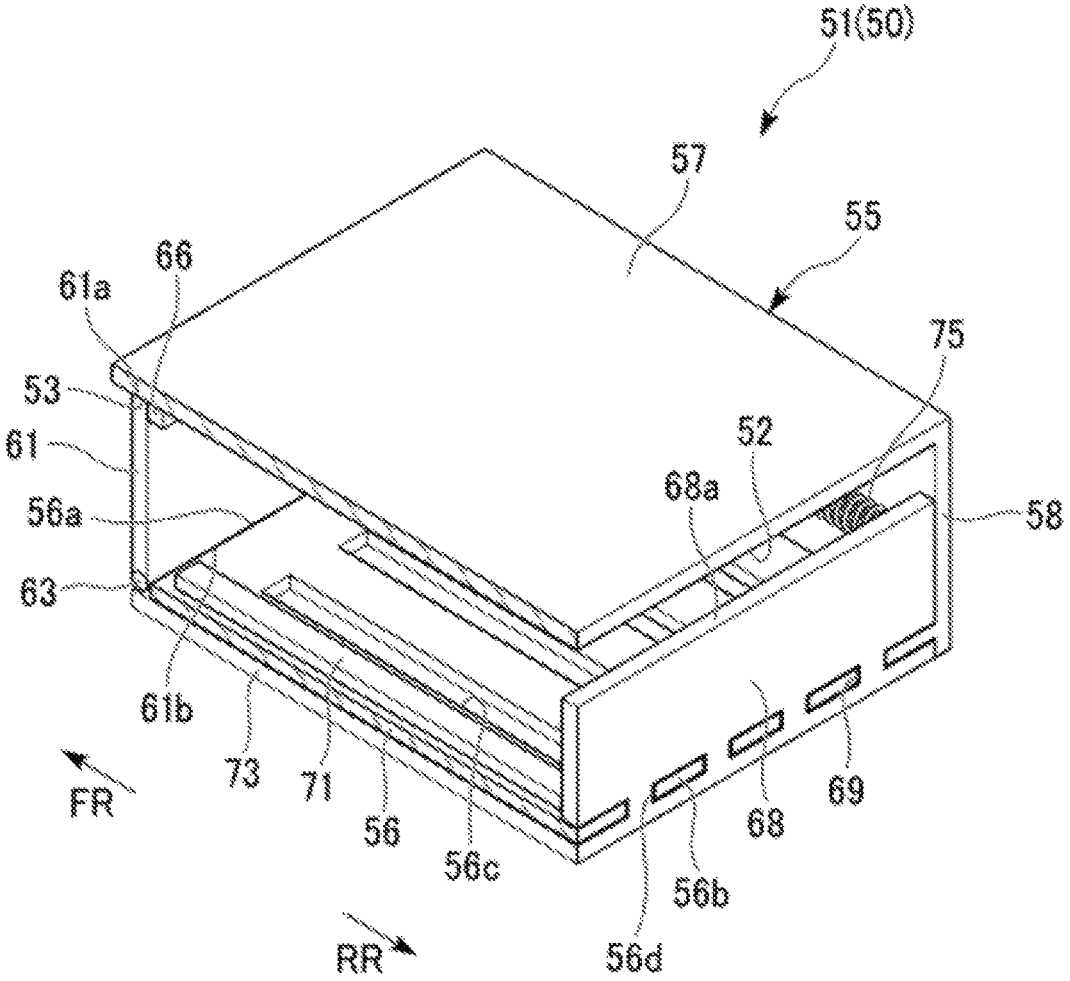
FIG. 5 is a perspective view illustrating a housing section according to the embodiment.

FIG. 5 is a perspective view illustrating the housing section according to the embodiment.

As shown in FIG. 5, the housing section 51 includes a housing section main body 55, a cover 61, a locking device 66, a rear wall 68 (sheet pushing wall), a cover pushing member 71, a cover support section 73 and a first energization member 75.

The housing section main body 55 is formed into a rectangular parallelepiped shape, which opens forward and rearward. An opening towards the front side of the housing section main body 55 is the removal port 53 of the housing section 51. The housing section main body 55 includes a bottom wall 56, a top wall 57, and a pair of side walls 58. In FIG. 5, only one side wall 58 is shown.

The bottom wall 56 constitutes the bottom of the housing section main body 55. A front end edge 56*a* and a rear end edge 56*b* of the bottom wall 56 extend in the left-right direction, respectively. The bottom wall 56 extends slightly upwards as it directs forward from the rear end edge 56*b*. On the bottom wall 56, a sheet S accommodated in the housing section 51 is placed. In the bottom wall 56, a plurality of slits 56*c* extending forward from the rear end edge 56*b* is formed. The plurality of slits 56*c* extends in parallel with each other. In other words, the bottom wall 56 includes a plurality of sinking comb 56*d* extending rearward.

The top wall 57 constitutes an upper portion of the housing section main body 55. The top wall 57 is parallel to the bottom wall 56.

The pair of side walls 58 constitutes portions on both sides in the left-right direction of the housing section main body 55. The pair of side walls 58 is arranged with a interval therebetween larger than the accommodated sheet S. The pair of side walls 58 extends in the vertical direction, respectively. The pair of side walls 58 connects the bottom wall 56 and the top wall, respectively.

The cover 61 closes the removal port 53 of the housing section 51 in an openable manner. The cover 61 is formed in a plate shape. The cover 61 is formed in a rectangular shape extending in both the vertical direction and the left-right direction when viewed from the forward direction. The upper end edge 61*a* of the cover 61 is arranged in the vicinity of the front end of the top wall 57. The lower end edge 61*b* of the cover 61 is arranged in the vicinity of the front end of the bottom wall 56. The cover 61 is provided to be capable of being displaced with respect to the housing section main body 55. The lower end of the cover 61 is connected to the front end of the bottom wall 56. The cover 61 is attached to the bottom wall 56 via a hinge 63. The cover 61 is rotatable around an axis extending in the left-right direction with respect to the bottom wall 56. The cover 61 rotates in such a manner that the upper end thereof circulates around the lower end thereof. The housing section 51 shifts from the storage state to the removal state when the upper end of the cover 61 is displaced forward.

As shown in FIG. 3, a spring 64 is attached to the hinge 63. For example, the spring 64 is a torsion coil spring. The spring 64 applies an energization force to the cover 61 in a direction of closing the cover 61. In other words, the spring 64 applies an energization force to the cover 61 via the hinge 63 so that the upper end of the cover 61 is displaced rearward.

As shown in FIG. 5, the locking device 66 regulates the rotation of the cover 61 for closing the removal port 53 of the housing section 51. For example, the locking device 66 is attached to the top wall 57. The operation of the locking device 66 is controlled by the safekeeping controller 100.

The rear wall 68 faces the removal port 53 across the accommodated sheet S. The rear wall 68 closes a part of the opening at rear side of the housing section main body 55. The rear wall 68 is formed in a plate shape. The rear wall 68 is formed in a rectangular shape extending in both the vertical direction and the left-right direction as viewed from the rear side. The rear wall 68 extends perpendicularly to the bottom wall 56. The upper end edge 68*a* of the rear wall 68 is arranged below the top wall 57 in the vicinity of the rear end of the top wall 57. Thereby, a gap is formed between the top wall 57 and the rear wall 68. The gap between the top wall 57 and the rear wall 68 is the entry port 52 of the housing section 51.

An insertion portion 69 is formed in the rear wall 68. For example, the insertion portion 69 is a plurality of through holes. The sinking comb 56*d* of the bottom wall 56 is inserted through the insertion portion 69 from the front side. As a result, the rear wall 68 can move forward with respect to the bottom wall 56 in a state of intersecting with the bottom wall 56 when viewed from the left-right direction.

The cover pushing member 71 extends forward from the rear wall 68. For example, the cover pushing member 71 is formed in a bar shape. The cover pushing member 71 is arranged above the bottom wall 56. The cover pushing member 71 is arranged between the sheet S placed on the bottom wall 56 and the side wall 58. The cover pushing member 71 extends substantially in parallel with the bottom wall 56. The cover pushing member 71 extends from the rear wall 68 to the rear side of the cover 61 and to the vicinity of the cover 61.

The cover support section 73 extends forward from the lower end of the rear wall 68. For example, the cover support section 73 is formed in a plate shape. The cover support section 73 extends along the lower surface of the bottom wall 56. The cover support section 73 extends from the rear wall 68 to the vicinity of the front end of the bottom wall 56.

The first energization member 75 energizes the rear wall 68 rearward with respect to the housing section main body 55. The first energization member 75 directly or indirectly energizes the rear wall 68. For example, the first energization member 75 may be connected to the housing section main body 55 and the rear wall 68. For example, the first energization member 75 may be arranged inside the housing section 51. The first energization member 75 is arranged at a position where it does not interfere with the operation of the sheet S accommodated in the housing section 51.

As shown in FIG. 1, the tray displacement unit 80 displaces the multistage tray 50 in the vertical direction with respect to the housing 20. For example, the tray displacement unit 80 is arranged in the housing 20. The tray displacement unit 80 includes a guide mechanism, a motor, and a power transmission section. The guide mechanism guides the multistage tray 50 in the vertical direction. The motor supplies a force to enable the multistage tray 50 to rise or fall. The power transmission section transmits power from the motor to the multistage tray 50. For example, the power transmission section is constituted by a pulley, a belt or the like.

As shown in FIG. 3, the cover displacement unit 90 is arranged in the housing 20. The cover displacement unit 90 displaces the cover 61 of one housing section 51 determined by the operation of the tray displacement unit 80 among the plurality of the housing sections 51 of the multistage tray 50. The cover displacement unit 90 displaces the cover 61 of the housing section 51 at a predetermined position in the vertical direction among a plurality of the housing sections 51. For example, the cover displacement unit 90 displaces the cover 61 of the housing section 51 at a position where the conveyance unit 41 can convey the sheet S. The cover displacement unit 90 pushes the rear wall 68 of the housing section 51 forward.

As shown in FIG. 3 and FIG. 4, the cover displacement unit 90 includes a rack 91, a pinion 92, a one-way clutch 93 and a second energization member 94. The cover displacement unit 90 includes a conveyance motor 43 of the conveyance unit 41.

As shown in FIG. 3, the rack 91 is provided to be movable forward and rearward. The rack 91 is bi-directionally displaced between a retraction position and an operating position in front of the retraction position. The retraction position is a position where the rack 91 retracts rearward from the multistage tray 50 as shown in FIG. 3. The retraction position is a position where the rack 91 does not contact with the multistage tray 50. The retraction position is a position where the rack 91 does not interfere with the displacement of the multistage tray 50 in the vertical direction. The rack 91 protrudes from the housing 20 towards the housing section 51 by moving forward from the retraction position. For example, the rack 91 protrudes from the housing 20 through the sheet discharge port 22.

The pinion 92 meshes with the rack 91. The pinion 92 rotates in a third direction to move the rack 91 forward. The pinion 92 is rotated by a rotational driving force from the conveyance motor 43 (refer to FIG. 4) of the conveyance unit 41. The pinion 92 rotates in the third direction by the rotational driving force from the conveyance motor 43 in the second direction.

As shown in FIG. 4, the rotational driving force from the conveyance motor 43 is transmitted to the one-way clutch 93. The one-way clutch 93 is arranged on a power transmission path from the conveyance motor 43 to the pinion 92. The one-way clutch 93 is connected to the conveyance motor 43 and the pinion 92 via a gear, a rotating shaft, a belt, and the like. The one-way clutch 93 cuts off the transmission of the rotational driving force from the conveyance motor 43 to the pinion 92 or transmits the rotational driving force to the pinion 92. The one-way clutch 93 transmits the rotational driving force from the conveyance motor 43 in the second direction to the pinion 92. The one-way clutch 93 cuts off the transmission of the rotational driving force from the conveyance motor 43 in the first direction to the pinion 92. As a result, the pinion 92 and the rack 91 do not operate when the conveyance roller 42 of the conveyance unit 41 normally rotates.

As shown in FIG. 3, the second energization member 94 energizes the rack 91 rearward. The second energization member 94 displaces the rack 91 towards the retraction position if the transmission of the power from the conveyance motor 43 to the rack 91 is stopped.

As shown in FIG. 2, the safekeeping controller 100 controls the overall operation of the sheet safekeeping apparatus 3. The safekeeping controller 100 controls the post-processing section 30 and the sheet safekeeping section 40. The safekeeping controller 100 includes a CPU 101 and a storage device 102 (storage section).

The storage device 102 stores a data table for storing identification information of the housing sections 51 of the multistage tray 50. In the data table, the identification information of each housing section 51 and identification information of a user are associated with each other. The storage device 102 stores information relating to the presence or absence of the sheet S accommodated in each housing section 51. For example, if the sheet S is accommodated in the empty housing section 51, the storage device 102 stores the identification information of the housing section 51 in which the sheet S is accommodated and the identification information of the user who executes a job.

Next, the operation of the sheet safekeeping apparatus 3 is described with reference to FIG. 3, FIG. 6 and FIG. 7.

Figure 6:
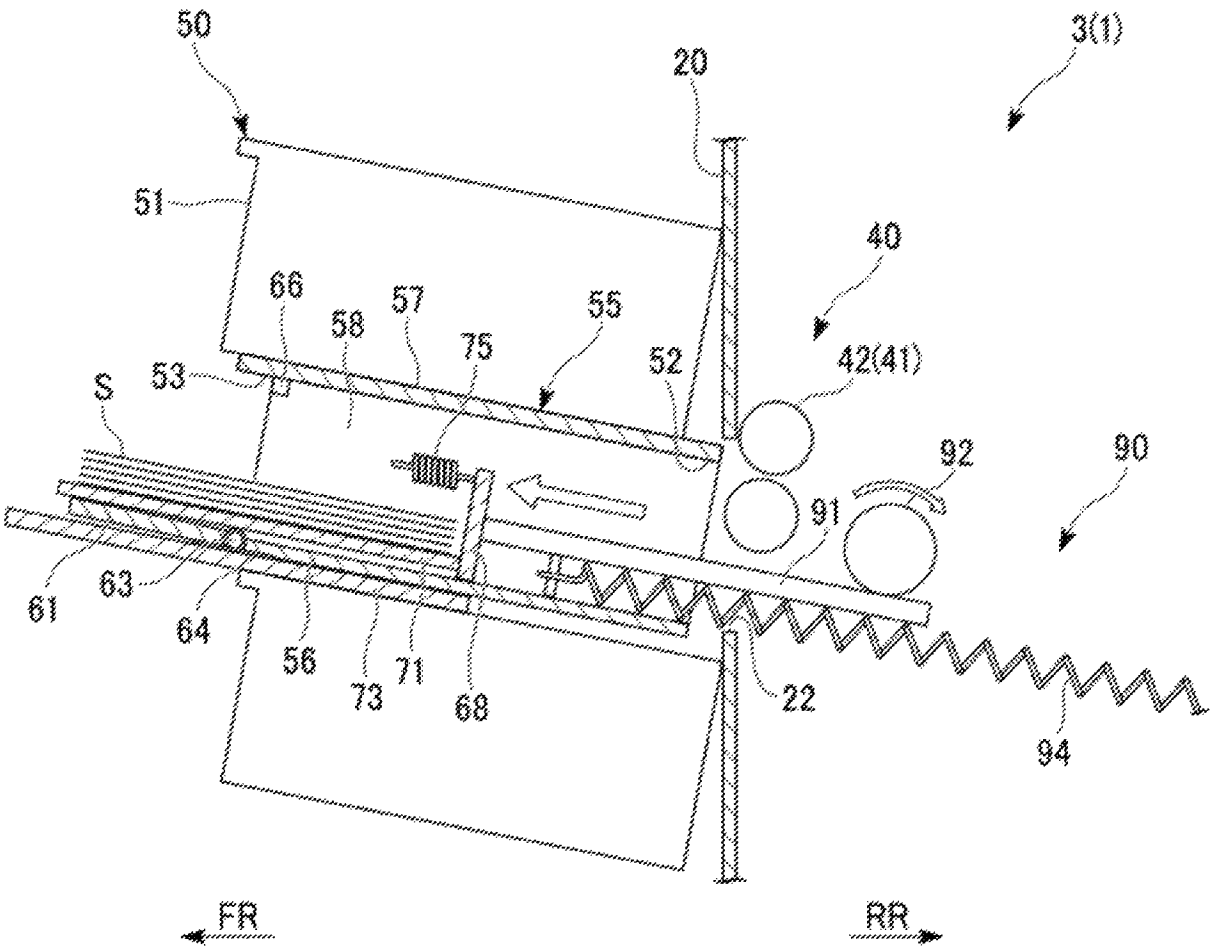
FIG. 6 is a diagram for explaining an operation of the sheet safekeeping apparatus according to the embodiment.
Figure 7:
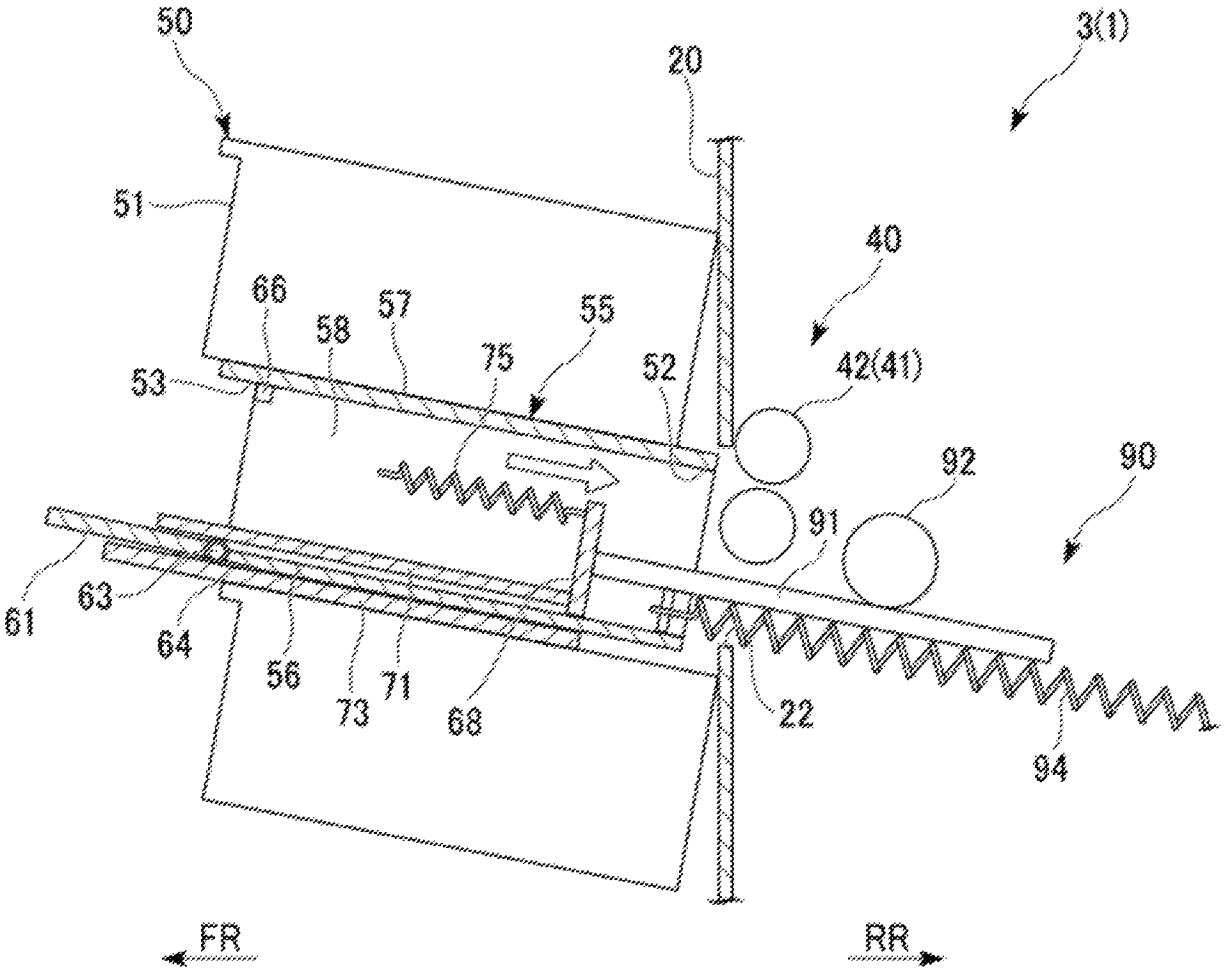
FIG. 7 is a diagram for explaining an operation of the sheet safekeeping apparatus according to the embodiment.

FIG. 6 and FIG. 7 are diagrams for explaining the operation of the sheet safekeeping apparatus according to the embodiment, and are front views illustrating a part of the sheet safekeeping apparatus in the embodiment.

As shown in FIG. 3 and FIG. 6, the cover displacement unit 90 moves the rack 91 forward by a predetermined distance from the retraction position to enable the rack 91 to contact with the rear wall 68 from the rear side. The cover displacement unit 90 further moves the rack 91 forward to move the rear wall 68, the cover pushing member 71 and the cover support section forward with respect to the bottom wall 56.

If the rear wall 68 moves forward with respect to the bottom wall 56, the rear wall 68 contacts with the sheet S placed on the bottom wall 56 from the rear side. As a result, the rear wall 68 pushes the sheet S towards the removal port 53 by the operation of the cover displacement unit 90. Since the rear wall 68 intersects with the bottom wall 56 when viewed from the left-right direction, the lowermost sheet S directly placed on the bottom wall 56 can also be reliably pushed.

If the cover pushing member 71 moves forward with respect to the bottom wall 56, the cover pushing member 71 contacts with the cover 61 from the rear side. The cover pushing member 71 further moves forward with respect to the bottom wall 56 to push the cover 61 forward. Then, the upper end of the cover 61 rotates forward against the energization force from the spring 64. As a result, the cover pushing member 71 can push the cover 61 with the cover displacement unit 90 to open the removal port 53.

The cover support section 73 protrudes forward from the bottom wall 56 as it moves forward with respect to the bottom wall 56. If the cover support section 73 protrudes forward from the bottom wall 56, the cover support section 73 can contact with the cover 61 rotatably connected to the front end of the bottom wall 56 from below. Thus, the cover support section 73 regulates a rotation range of the cover 61. For example, the cover support section 73 prevents the cover 61 from being excessively opened due to the weight of the sheet S when the cover 61 is opened and the sheet S is pushed by the rear wall 68 and is located above the cover 61.

The cover displacement unit 90 finishes the operation of opening the removal port 53 by enabling the rack 91 to reach the operating position shown in FIG. 6.

As shown in FIG. 7, the cover displacement unit 90 stops the transmission of the driving force from the conveyance motor 43 to the rack 91 when the removal port 53 is closed. The rack 91 is then pulled rearward by the second energization member 94 to retract from the operating position towards the retraction position.

The rear wall 68 moves rearward by the energization force of the first energization member 75 when the rack 91 retracts from the operating position. The cover pushing member 71 and the cover support section 73 moves rearward in conjunction with the rear wall 68. If the cover pushing member 71 moves rearward, the cover 61 rotates in such a manner that the upper end moves upward and rearward by the energization force of the spring 64. As a result, the cover 61 closes the removal port 53 of the housing section 51.

If the sheet S is placed on the bottom wall 56 when the rear wall 68 moves rearward, the sheet S moves rearward together with the rear wall 68 due to the inclination of the bottom wall 56. As a result, the sheet S placed on the bottom wall 56 does not hinder the operation of closing the cover 61.

Next, the control by the safekeeping controller 100 is described.

When the sheet S is conveyed from the image forming apparatus main body 2, the safekeeping controller 100 determines a conveyance destination of the sheet S according to the job. For example, the safekeeping controller 100 conveys the sheet S to the fixed tray 23 if there is no identification information of the user associated with the job. For example, the safekeeping controller 100 conveys the sheet S to the sheet discharge port 22 if the identification information of the user is associated with the job.

The safekeeping controller 100 controls the sheet safekeeping section 40 in response to the user who executes the job if the conveyance destination of the sheet S is determined as the sheet discharge port 22. The safekeeping controller 100 determines whether or not the identification information of the user who executes the job is included in the data table.

If the identification information of the user who executes the job is included in the data table, the safekeeping controller 100 acquires the associated identification information of the housing section 51. The safekeeping controller 100 controls the tray displacement unit 80 so that the entry port 52 of the target housing section 51 faces the sheet discharge port 22, based on the acquired identification information of the housing section 51. Specifically, the safekeeping controller 100 displaces the multistage tray 50 with the tray displacement unit 80 so that the sheet S can be conveyed to the housing section 51 corresponding to the user who executes the job.

If the identification information of the user who executes the job is not included in the data table, the safekeeping controller 100 accommodates the sheet S in the empty housing section 51. Specifically, the safekeeping controller 100 controls the tray displacement unit 80 so that the entry port 52 of the empty housing section 51 faces the sheet discharge port 22. At this time, the safekeeping controller 100 stores the identification information of the user who executes the job in the storage device 102 in association with the identification information of the housing section 51.

If the operation of the tray displacement unit 80 is terminated, the safekeeping controller 100 controls the conveyance unit 41 to send a sheet S from the sheet discharge port 22. As a result, the sheet S is accommodated in the housing section 51.

The safekeeping controller 100 determines the housing section 51 whose removal port 53 is to be opened in response to the operation by the user on the control panel 11. The safekeeping controller 100 controls the sheet safekeeping section 40 when receiving an instruction to take out the sheet from a user authenticated by the user authentication section 16. The safekeeping controller 100 refers to the data table to acquire the identification information of the housing section 51 corresponding to the user who issues the instruction to take out the sheet. The safekeeping controller 100 controls the tray displacement unit 80 so that the rear wall 68 of the target housing section 51 faces the front end of the rack 91 based on the acquired identification information of the housing section 51. The safekeeping controller 100 controls the locking device 66 of the target housing section 51 to unlock the cover 61. The safekeeping controller 100 controls the cover displacement unit 90 to move the rack 91 forward when the operation of the locking device 66 is completed. As a result, the removal port 53 of the housing section 51 corresponding to the user who issues the instruction to take out the sheet is opened.

The safekeeping controller 100 controls the sheet safekeeping section 40 so that the cover 61 of the housing section 51 can be opened for a predetermined period of time. Specifically, the safekeeping controller 100 controls the cover displacement unit 90 so that the cover 61 closes the removal port 53 after a predetermined period of time has elapsed since the removal port 53 of the housing section 51 is opened. Specifically, the safekeeping controller 100 controls the cover displacement unit 90 to retract the rack 91 after a predetermined period of time has elapsed since the removal port 53 of the housing section 51 is opened. The safekeeping controller 100 controls the locking device 66 to lock the cover 61 when the rack 91 retracts and the removal port 53 is closed. Thus, the sheet S in the housing section 51 cannot be taken out.

Hereinafter, the effects of the present embodiment are described.

The sheet safekeeping apparatus 3 of the present embodiment comprises the cover displacement unit 90. The cover displacement unit 90 displaces the cover 61 of one housing section 51 among the plurality of the housing sections 51 of the multistage tray 50 to open the removal port 53. The one housing section 51 is determined by the operation of the tray displacement unit 80. According to such a configuration, the cover 61 can be opened and closed by the cover displacement unit 90 without arranging a driving source for displacing the cover 61 to each of the plurality of the housing sections 51. Therefore, it is possible to prevent the configuration of the sheet safekeeping apparatus 3 from becoming complicated.

The cover pushing member 71 is provided for each of the plurality of the housing sections 51. The cover pushing member 71 pushes the cover 61 by the operation of the cover displacement unit 90 to open the removal port 53. According to such a configuration, the cover displacement unit 90 can displace the cover 61 without directly contacting with the cover 61. As a result, the cover displacement unit 90 can displace the cover 61 by an operation thereof at a relatively short distance from a position where it does not interfere with the displacement of the multistage tray 50 by the tray displacement unit 80. Therefore, it is possible to prevent the cover displacement unit 90 from becoming large.

The rear wall 68 is provided for each of the plurality of the housing sections 51. The rear wall 68 faces the removal port 53 across the sheet S accommodated in the housing section 51. The rear wall 68 pushes the sheet S towards the removal port 53 by the operation of the cover displacement unit 90. According to such a configuration, the rear wall 68 can move the sheet S towards the removal port 53 while aligning the rear end of the sheet S. As a result, the sheet safekeeping apparatus 3 can discharge the sheet S from the removal port 53 with the rear end of the sheet S aligned. Therefore, it is possible to discharge the bundle of sheets S with the bundle of sheets S accommodated in the housing section 51 aligned.

The bottom wall 56 on which the accommodated sheet S is placed is provided for each of the plurality of the housing sections 51. The rear wall 68 intersects with the bottom wall 56 when viewed from the left-right direction. According to such a configuration, no gap is formed between the upper surface of the bottom wall 56 and the rear wall 68 when viewed from the left-right direction. Therefore, the rear wall 68 can reliably push the lowermost sheet S among the sheets S placed on the bottom wall 56. Therefore, the sheet safekeeping apparatus 3 can reliably discharge all of the accommodated sheets S from the removal port 53.

The cover displacement unit 90 includes the rack 91 and the pinion 92. The rack 91 is bi-directionally displaced between the retraction position where the rack 91 retracts from the multistage tray 50 and the operating position where the rack 91 protrudes from the housing 20 towards the housing section 51. The pinion 92 meshes with the rack 91 to displace the rack 91. According to such a configuration, the rack 91 does not interfere with the displacement of the multistage tray 50 at the retraction position. The rack 91 can contact with the housing section 51 at the operating position to displace the cover 61. Thus, the cover displacement unit 90 can open the removal port 53 by displacing the cover 61 of one housing section 51 determined by the operation of the tray displacement unit 80.

The cover displacement unit 90 includes the conveyance motor 43 of the conveyance unit 41. The cover displacement unit 90 operates by the driving force from the conveyance motor 43. According to such a configuration, the number of the driving sources of the whole sheet safekeeping apparatus 3 can be reduced as compared with the case in which the cover displacement unit has a drive source separated from that of the conveyance motor 43. Therefore, it is possible to prevent the configuration of the sheet safekeeping apparatus 3 from being complicated.

The cover displacement unit 90 includes the one-way clutch 93 to which the driving force from the conveyance motor 43 is transmitted. The one-way clutch 93 cuts off the transmission of the driving force from the conveyance motor 43 when the sheet S is sent to one housing section 51 by the conveyance roller 42 of the conveyance unit 41. According to such a configuration, the cover displacement unit 90 does not displace the cover 61 when the conveyance unit 41 conveys the sheet S to the housing section 51. Therefore, in the configuration in which the conveyance unit 41 and the cover displacement unit 90 use the driving source together, the conveyance unit 41 can operate independently from the cover displacement unit 90.

A plurality of the housing sections 51 is provided side by side in the vertical direction. According to such a configuration, an installation area of the multistage tray 50 can be reduced when compared with the case in which a plurality of the housing sections is arranged in a direction intersecting with the vertical direction. Accordingly, it is possible to provide the sheet safekeeping apparatus 3 with installation area thereof reduced.

The safekeeping controller 100 controls the cover displacement unit 90 so that the cover 61 closes the removal port 53 after a predetermined period of time has elapsed since the removal port 53 of the housing section 51 is opened. According to such a configuration, it is possible to prevent the removal port 53 of the housing section 51 from being kept open. Therefore, it is possible to provide the sheet safekeeping apparatus 3 suitable for accommodating confidential documents.

The safekeeping controller 100 opens the removal port of one housing section 51 corresponding to the authenticated user when the user is authenticated by the user authentication section 16. According to such a configuration, only the authenticated user can take out the sheet S from the housing section 51. In other words, it is possible to prevent an unauthenticated user from taking out the sheet S from the housing section 51. Therefore, it is possible to provide the sheet safekeeping apparatus 3 suitable for accommodating confidential documents.

The safekeeping controller 100 comprises the storage device 102. The storage device 102 stores the information relating to the presence or absence of the sheets S accommodated in the plurality of the housing sections 51. According to such a configuration, the sheet safekeeping apparatus 3 can accommodate the sheet S in the housing section 51 according to the presence or absence of the sheets S accommodated in the plurality of the housing sections 51.

The storage device 102 stores the identification information of the user who executes the job at the time of accommodating the sheets S in the plurality of the housing section 51. According to such a configuration, the sheet safekeeping apparatus 3 can allocate the plurality of the housing sections 51 for each user. Therefore, at the time of accommodating the sheet S, the sheet safekeeping apparatus 3 can accommodate the sheet S in the housing section 51 corresponding to the user who executes the job.

The image forming apparatus 1 comprises the sheet safekeeping apparatus 3 and the image forming apparatus main body 2. According to such a configuration, the image forming apparatus 1 can accommodate the sheets S in the plurality of the housing sections 51.

In the above embodiment, the image forming apparatus 1 having the printer section 13 is taken as an example of the image processing apparatus provided with the sheet safekeeping apparatus 3, but it is not limited thereto. The image processing apparatus provided with the sheet safekeeping apparatus 3 may be a decoloring device that performs a decoloring processing on a sheet on which an image is formed.

In the above embodiment, the tray displacement unit 80 is arranged in the housing 20, but it is not limited thereto. For example, the tray displacement unit 80 may be arranged in the multistage tray.

In the above embodiment, the tray displacement unit 90 includes the power transmission section constituted by the pulley, the belt, and the like, but it is not limited thereto. For example, the power transmission section may be a rack and pinion mechanism, a ball screw, or the like.

In the above-described embodiment, the removal port 53 of the housing section 51 is opened forward, but it is not limited thereto. For example, the removal port may be opened in either the left direction or the right direction.

In the above embodiment, the cover 61 of the housing section 51 is connected to the bottom wall 56, but it is not limited thereto. For example, the cover of the housing section may be connected to the top wall 57 or the side wall 58. For example, the cover of the housing section may be connected to the cover pushing member or the cover support section to be capable of moving forward and rearward in conjunction with the rear wall 68.

In the above embodiment, the cover displacement unit 90 includes the rack 91 and the pinion 92, but it is not limited thereto. For example, the cover displacement unit may move a member corresponding to the rack 91 of the embodiment forward and rearward with a solenoid and an energization member.

In the above-described embodiment, the plurality of the housing sections 51 is provided side by side in the vertical direction, but it is not limited thereto. For example, the plurality of the housing sections may be provided side by side in the horizontal direction. As a result, it is possible to reduce the height of the multistage tray.

In the above embodiment, the user authentication section 16 is included in the image forming apparatus main body 2 and is shared by the image forming apparatus main body 2 and the sheet safekeeping apparatus 3, but it is not limited thereto. The user authentication section may be provided in the sheet safekeeping apparatus 3 alone.

In the above embodiment, the cover displacement unit 90 is capable of displacing the cover 61 of the housing section 51 at a position where the conveyance unit 41 can convey the sheet S. However, it is not limited thereto. For example, the cover displacement unit 90 may be capable of displacing the cover 61 of the housing section 51 at a height position different from the position at which the conveyance unit 41 can convey the sheet S.

In the above embodiment, each of the housing sections 51 may be provided with a sensor for determining whether or not the sheet S is accommodated. Then, the safekeeping controller 100 may control the sheet safekeeping section 40 based on the detection results of the sensors.

According to at least one embodiment described above, the sheet safekeeping apparatus comprises the cover displacement unit. The cover displacement unit opens the removal port by displacing the cover of one housing section among the plurality of the housing sections of the multistage tray. The one housing section is determined by the operation of the tray displacement unit. Thereby, the cover can be opened and closed by the cover displacement unit without arranging a driving source for displacing the cover in each of the plurality of the housing sections. Therefore, it is possible to prevent the configuration of the sheet safekeeping apparatus from being complicated.

While certain embodiments have been described these embodiments have been presented by way of example only, and are not intended to limit the scope of the inventions. Indeed, the novel embodiments described herein may be embodied in a variety of other forms: furthermore various omissions, substitutions and changes in the form of the embodiments described herein may be made without departing from the spirit of the inventions. The accompanying claims and there equivalents are intended to cover such forms or modifications as would fall within the scope and spirit of the invention.

What is claimed is:

1. A sheet safekeeping apparatus, comprising:

a multistage tray in which a plurality of housing sections for accommodating sheets is arranged side by side in a first direction, a removal port through which an accommodated sheet is taken out being formed in each of the plurality of the housing sections, and a cover configured to close the removal port in an openable manner being provided in each of the plurality of the housing sections;

a support section configured to support the multistage tray;

a tray displacement unit configured to displace the multistage tray in the first direction with respect to the support section;

a conveyance unit, arranged in the support section, configured to convey a sheet to the plurality of the housing sections; and a cover displacement unit, arranged in the support section, configured to displace the cover of one housing section determined by an operation of the tray displacement unit among the plurality of the housing sections to open the removal port.

2. The sheet safekeeping apparatus according to claim 1, further comprising:

a cover pushing member for pushing the cover by the operation of the cover displacement unit to open the removal port is provided for each of the plurality of the housing sections.

3. The sheet safekeeping apparatus according to claim 1, further comprising:

a sheet pushing wall facing the removal port across the accommodated sheet and pushing the sheet towards the removal port by the operation of the cover displacement unit is provided for each of the plurality of the housing sections.

4. The sheet safekeeping apparatus according to claim 3, further comprising:

a bottom wall on which the accommodated sheet is placed is provided for each of the plurality of the housing sections, and the sheet pushing wall intersects with the bottom wall as viewed in a direction orthogonal to a direction in which the sheet pushing wall pushes the sheet in a horizontal direction.

5. The sheet safekeeping apparatus according to claim 1, wherein the cover displacement unit comprises a rack bi-directionally displaced between a retraction position retracted from the multistage tray and a protrusion position protruded from the support section to the one housing section, and a pinion meshing with the rack to displace the rack.

6. The sheet safekeeping apparatus according to claim 1, wherein the conveyance unit comprises a conveyance roller configured to send the sheet to the one housing section, and a conveyance motor configured to drive the conveyance roller, and the cover displacement unit comprises the conveyance motor and operates by a driving force from the conveyance motor.

7. The sheet safekeeping apparatus according to claim 6, wherein the cover displacement unit further comprises a one-way clutch through which the driving force from the conveyance motor is transmitted, and the one-way clutch cuts off transmission of the driving force from the conveyance motor when the conveyance roller sends the sheet to the one housing section.

8. The sheet safekeeping apparatus according to claim 1, further comprising:

a controller configured to control the cover displacement unit, wherein the controller controls the cover displacement unit to close the removal port with the cover after a predetermined period of time has elapsed since the removal port is opened.

9. The sheet safekeeping apparatus according to claim 1, further comprising:

a controller configured to control the tray displacement unit and the cover displacement unit; and a user authentication section configured to authenticate a user based on personal authentication information of a user, wherein the controller controls the tray displacement unit and the cover displacement unit to open the removal port of the one housing section corresponding to an authenticated user if the user is authenticated by the user authentication section.

10. An image processing apparatus, comprising:

a sheet safekeeping apparatus; and an image processing apparatus main body configured to form an image on a sheet and to send the sheet to the sheet safekeeping apparatus, wherein the sheet safekeeping apparatus comprises:

a multistage tray in which a plurality of housing sections for accommodating sheets is arranged side by side in a first direction, a removal port through which an accommodated sheet is taken out being formed in each of the plurality of the housing sections, and a cover for closing the removal port in an openable manner being provided in each of the plurality of the housing sections;

a support section configured to support the multistage tray;

a tray displacement unit configured to displace the multistage tray in the first direction with respect to the support section;

a conveyance unit, arranged in the support section, configured to convey a sheet to the plurality of the housing sections; and a cover displacement unit, arranged in the support section, configured to displace the cover of one housing section determined by an operation of the tray displacement unit among the plurality of the housing sections to open the removal port.

11. The image processing apparatus according to claim 10, further comprising:

a cover pushing member for pushing the cover by the operation of the cover displacement unit to open the removal port is provided for each of the plurality of the housing sections.

12. The image processing apparatus according to claim 10, further comprising:

a sheet pushing wall facing the removal port across the accommodated sheet and pushing the sheet towards the removal port by the operation of the cover displacement unit is provided for each of the plurality of the housing sections.

13. The image processing apparatus according to claim 12, further comprising:

a bottom wall on which the accommodated sheet is placed is provided for each of the plurality of the housing sections, and the sheet pushing wall intersects with the bottom wall as viewed in a direction orthogonal to a direction in which the sheet pushing wall pushes the sheet in a horizontal direction.

14. The image processing apparatus according to claim 10, wherein the cover displacement unit comprises a rack bi-directionally displaced between a retraction position retracted from the multistage tray and a protrusion position protruded from the support section to the one housing section, and a pinion meshing with the rack to displace the rack.

15. The image processing apparatus according to claim 10, wherein the conveyance unit comprises a conveyance roller configured to send the sheet to the one housing section, and a conveyance motor configured to drive the conveyance roller, and the cover displacement unit comprises the conveyance motor and operates by a driving force from the conveyance motor.

16. The image processing apparatus according to claim 15, wherein the cover displacement unit further comprises a one-way clutch through which the driving force from the conveyance motor is transmitted, and the one-way clutch cuts off transmission of the driving force from the conveyance motor when the conveyance roller sends the sheet to the one housing section.

17. The image processing apparatus according to claim 10, further comprising:

a controller configured to control the cover displacement unit, wherein the controller controls the cover displacement unit to close the removal port with the cover after a predetermined period of time has elapsed since the removal port is opened.

18. The image processing apparatus according to claim 10, further comprising:

a controller configured to control the tray displacement unit and the cover displacement unit; and a user authentication section configured to authenticate a user based on personal authentication information of a user, wherein the controller controls the tray displacement unit and the cover displacement unit to open the removal port of the one housing section corresponding to an authenticated user if the user is authenticated by the user authentication section.

19. A sheet safekeeping method, comprising:

displacing a multistage tray in a first direction with respect to a support section, the multistage tray comprising a plurality of housing sections for accommodating sheets arranged side by side in the first direction, a removal port through which an accommodated sheet is taken out being formed in each of the plurality of the housing sections, and a cover for closing the removal port in an openable manner provided in each of the plurality of the housing sections;

conveying a sheet from the support section to the plurality of the housing sections; and displacing the cover of one housing section determined by an operation of the displacing among the plurality of the housing sections to open the removal port using a cover displacement unit from the support section.

20. The sheet safekeeping method according to claim 19, further comprising:

pushing the cover by the operation of the displacing to open the removal port.

* * * * *